United States Patent [19]

Fewell

[11] 4,079,825

[45] Mar. 21, 1978

[54] PORTABLE BRAILLE TYPEWRITER

[76] Inventor: William B. Fewell, 124 Dow Rd., Port Charlotte, Fla. 33952

[21] Appl. No.: 748,372

[22] Filed: Dec. 7, 1976

[51] Int. Cl.[2] ..... B41J 3/32

[52] U.S. Cl. ..... 197/6.1; 101/18; 197/179

[58] Field of Search ..... 197/6.1, 60, 82, 86, 197/176, 179; 101/3 R, 18, 28, 29

[56] References Cited

U.S. PATENT DOCUMENTS

| | | | |
|---|---|---|---|
| 389,756 | 9/1888 | McElroy | 197/6.1 |
| 579,433 | 3/1897 | Hertzberg | 197/6.1 |
| 755,420 | 3/1904 | Wayne | 197/6.1 |
| 2,742,997 | 4/1956 | Zalisko | 197/6.1 |
| 3,823,804 | 7/1974 | Lokey | 197/6.1 |
| 3,876,051 | 4/1975 | Joffe | 197/6.1 |

FOREIGN PATENT DOCUMENTS

| | | | |
|---|---|---|---|
| 10,099 | 2/1909 | United Kingdom | 197/6.1 |
| 177,292 | 3/1922 | United Kingdom | 197/6.1 |

*Primary Examiner*—Paul T. Sewell

[57] ABSTRACT

A portable typewriter for embossing paper or the like according to the Braille code system and other like systems. It consists generally of a base having a matrix of Braille cells, a vertical track which guides a horizontal track upon which a keyboard transverses. The keyboard has six keys as well as bars for tab setting, clearing, and by-passing and bars for spacing and keyboard return. The close spacing of the keys allows two or more keys to be depressed using one or more fingers. This bridging expedites typing speed.

9 Claims, 10 Drawing Figures

PORTABLE BRAILLE TYPEWRITER

OBJECTS OF THE INVENTION

This invention has for an object to provide a portable means for typing braille dots and may be used by persons having physical handicaps which deter facilitation of present braille typewriters. For example, this apparatus may be operable by blind persons having the use of only one hand and three fingers, and where deaf, may know when a written line is to be ended where a ball warning cannot be heard.

A further object of this invention is to provide a means of typing in various convalescent body positions (i.e., lying in the horizontal position with one arm in traction). The apparatus may be handled similarly to a common clipboard.

Still a further objective of this invention is to expedite braille typing speed whereas the keyboard keys are spaced close to one another such that one finger may bridge two or more keys and one stroke of the hand will produce up to six dots. Many blind persons utilize the awl punching method which produces braille characters in reverse of their read form. The familiarization of that method may be easily transferred to this apparatus where, on the other hand, braille typewriters which emboss characters in their unreversed form require a new familiarity or learning process.

A further objective is to provide a typing means for blind persons during field trips where the apparatus may be held cradled in the arm and notes may be taken while the person is mobile.

DETAILED DESCRIPTION OF THE INVENTION

Figure 1:
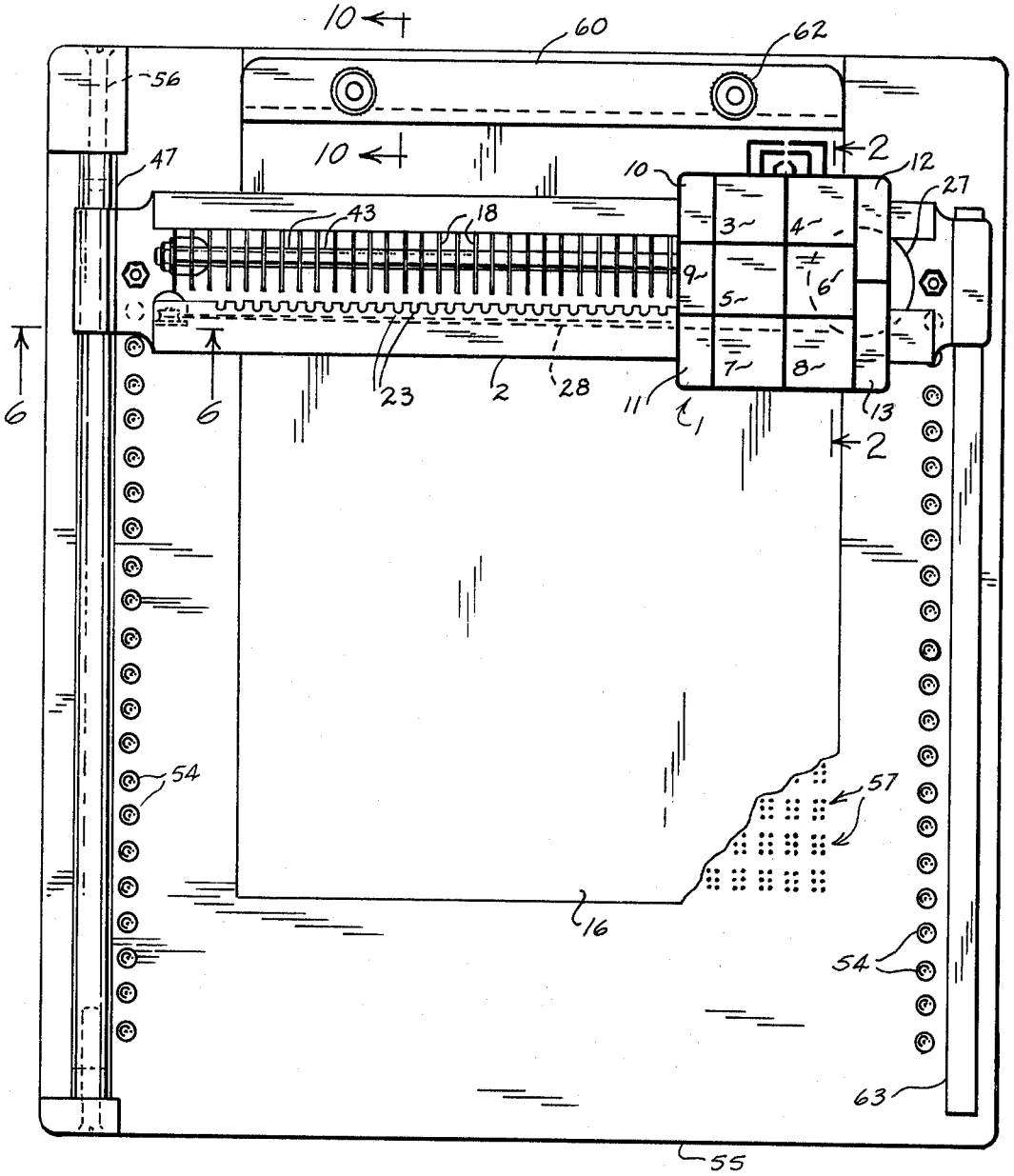
FIG. 1 is a top plan view of the invention.

Having reference to the drawings, the device is more fully described as follows:

A keyboard indicated by arrow 1 transverses upon a horizontal track 2 and is comprised of six keys 3–8, a tab setting bar 9, a tab clearing bar 10, a tab by-pass bar 11, a keyboard return bar 12, a spacer bar 13, an escapement activating bar 14, and rollers 15. The keyboard 2 is seen in relation to other parts of the device in FIG. 1.

To form a braille character, one key 3–8 is depressed or a number of keys are depressed simultaneously. When a key 3–8 is depressed, a stem 3*a*–8*a* is forced downward along with connecting arm 3*b*–8*b* attached thereto by fastener 40 and forcing downward a projectile point at the end of arm 3*b*–8*b* causing an indentation in a writing surface material such as paper 16. A spring 17 returns the key 3–8 to its normal position. See FIGS. 2 and 3.

Figure 2:
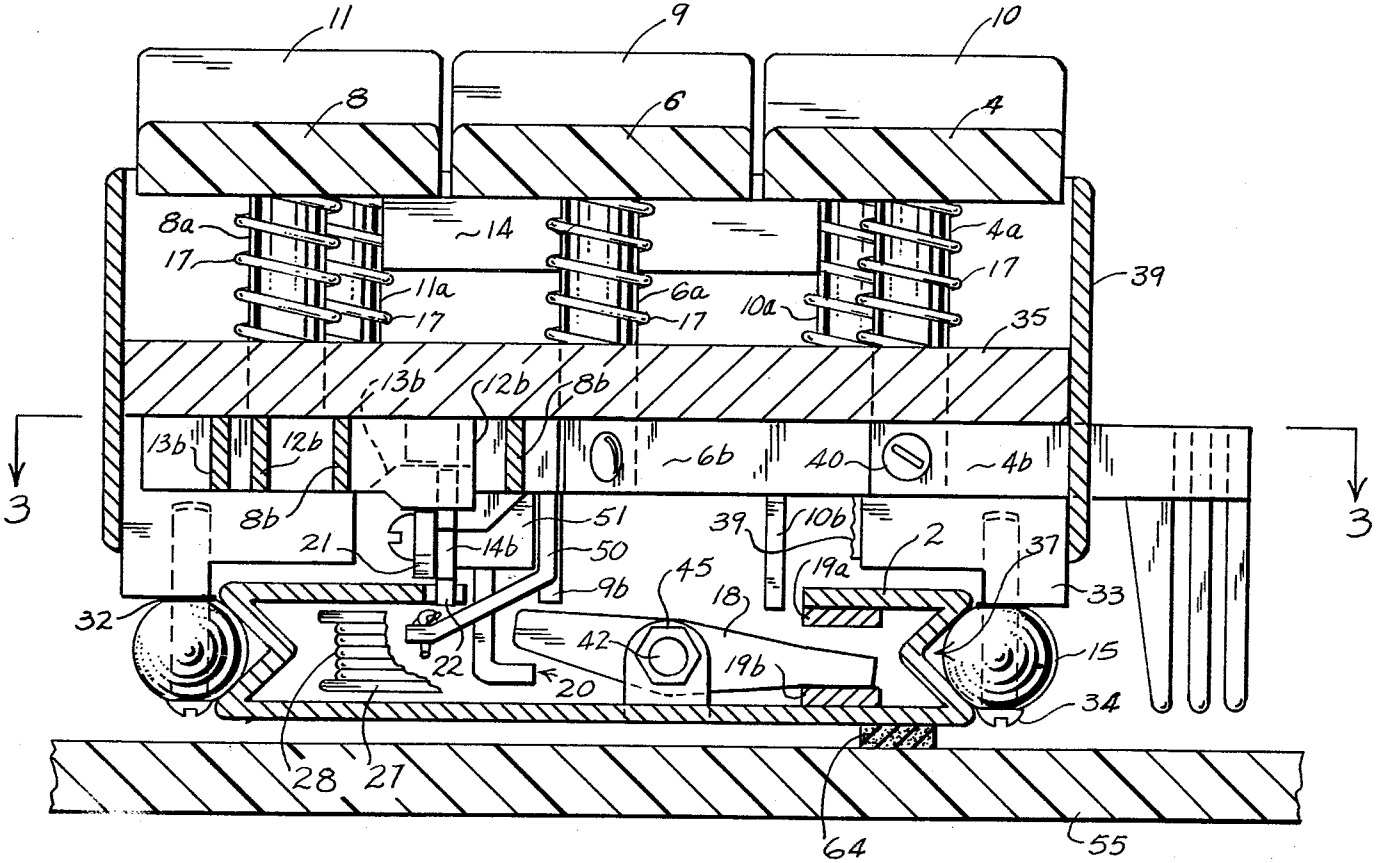
FIG. 2 is a sectional view taken substantially along the line 2—2 of FIG. 1. The lower portion of cover 39 is broken away for clarity, as well as a portion of the spring reel and cord 27 and 28.
Figure 3:
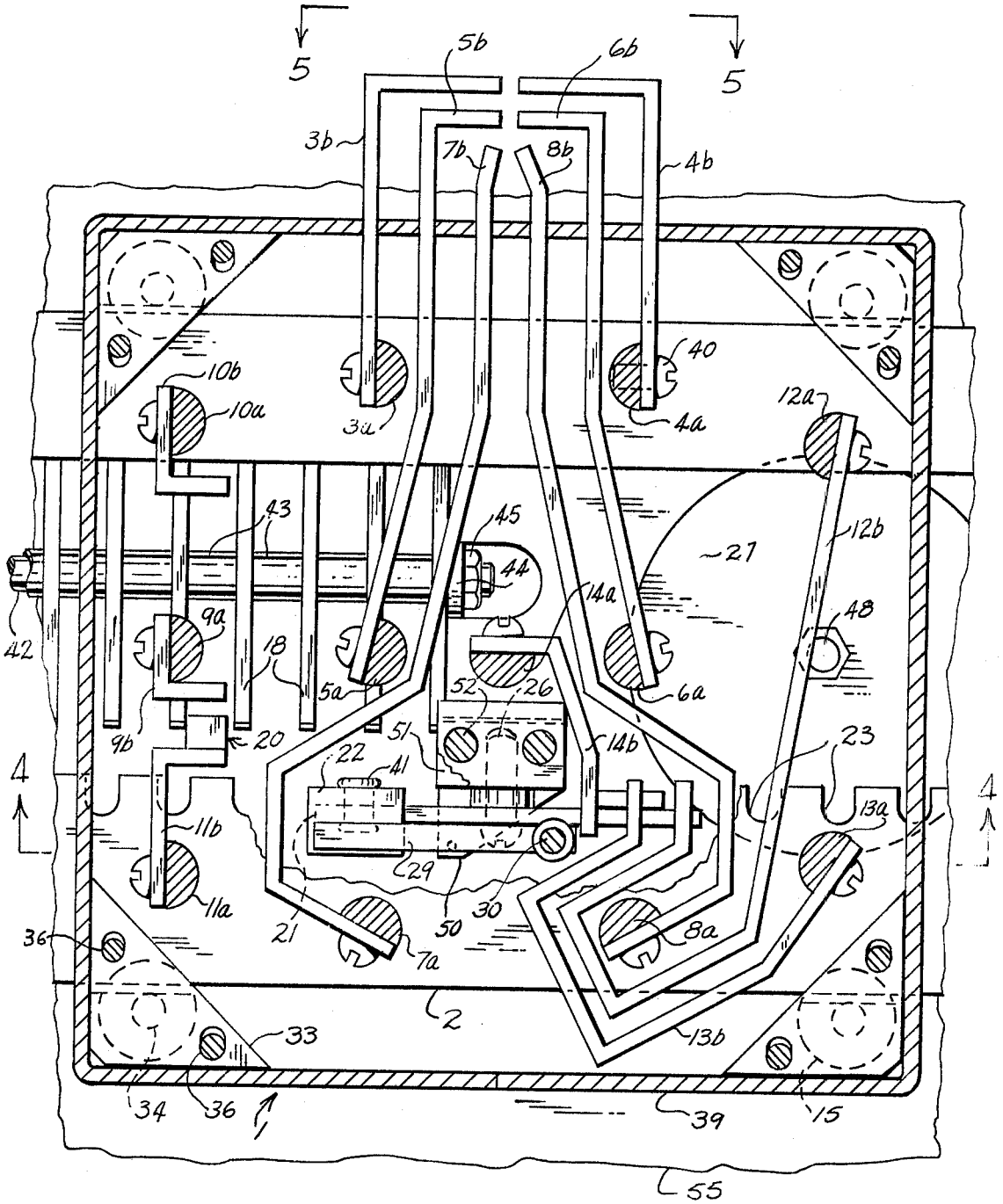
FIG. 3 is a sectional view taken substantially along the line 3—3 of FIG. 2. The matrix of indentations in the base 55 are not shown for clarity purposes, and the base 55 is shown fragmentary.

To set a tab 18, the tab setting bar 9 is depressed causing a stem 9*a* and an arm 9*b*, attached thereto, to force downward a tab 18. The tab 18, of ferrous material, remains in the "on" position as it contacts a magnetized strip 19*a*, of ferrous or ferrous contained material, attached to the horizontal track 2. Spring 17 returns the tab setting bar 9 to its normal position. To clear the tab 18, the tab clearing bar 10 is depressed which causes a stem 10*a* and an arm 10*b*, attached thereto, to force downward a tab 18. The tab 18 remains in the "off" position as it contacts a magnetized strip 19*b*, of ferrous or ferrous contained material. Spring 17 returns the tab clearing bar 10 to its normal position. FIG. 2 shows tab 18 in the "off" position. When a tab 18 is set in the "on" position, an arm 11*b* of the tab by-pass bar 11 prevents the keyboard 1 from moving to the left. In order for the keyboard 1 to pass, the tab by-pass bar 11 is depressed causing a stem 11*a* and an arm 11*b* attached thereto to be forced downward thereby causing a foot 20 indicated by arrow of arm 11*b* to clear the tab 18. At the same time that the tab by-pass bar 11 is depressed, the spacer bar 13 is depressed which allows movement of the keyboard 1 to the left.

Figure 4:
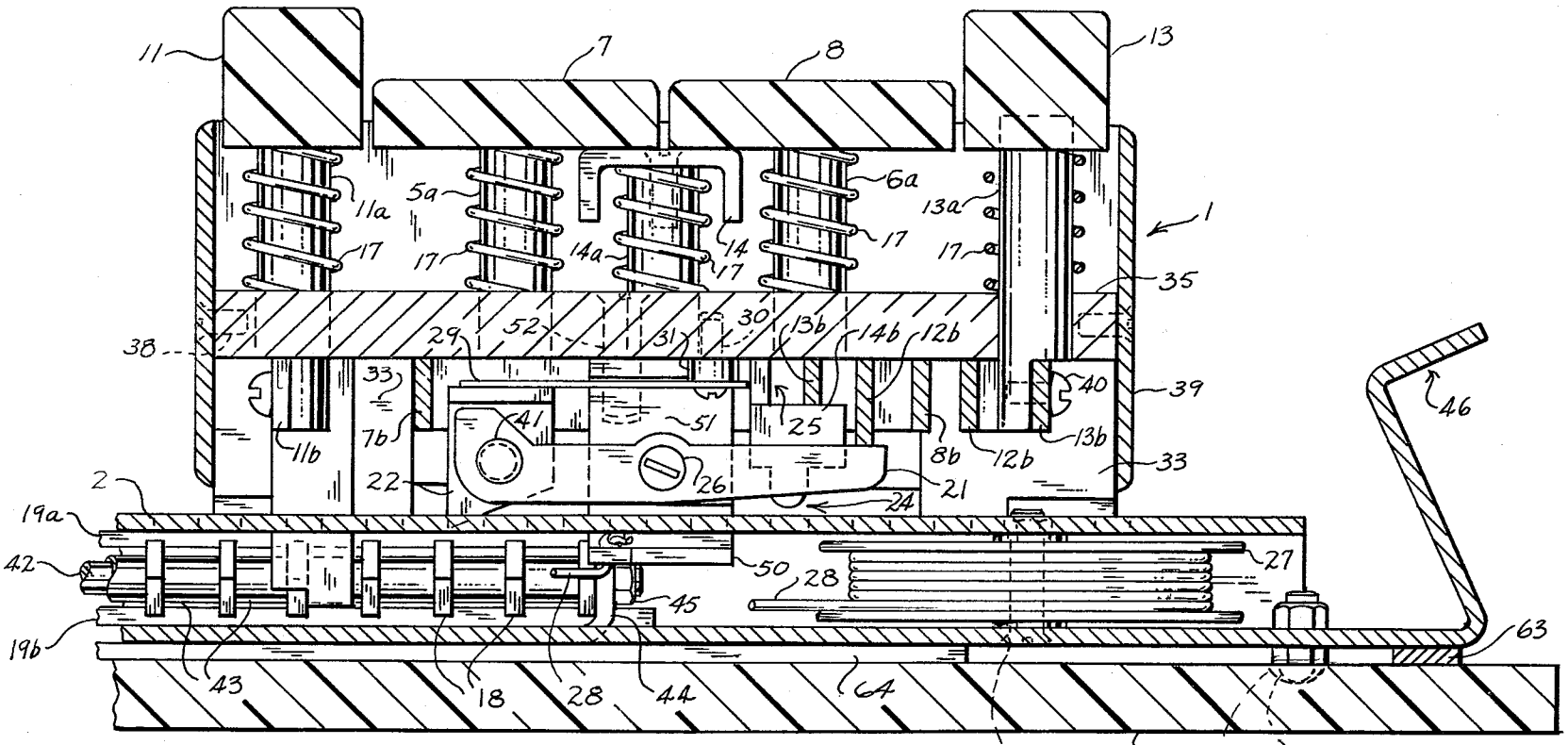
FIG. 4 is a sectional view taken substantially along the line 4—4 of FIG. 3.

The spacer bar 13 is used for intermittent spacing. To space, the spacer bar 13 is depressed causing a rod 13*a* and an arm 13*b*, attached thereto, to force downward a lever 21 which activates an escapement system described herein, and it allows the keyboard 1 to move one space at a time. When the keyboard 1 is to be moved without the need for intermittent spacing, the keyboard return bar 12 is depressed causing a stem 12*a* and an arm 12*b*, attached thereto, to force downward a lever 21 which disengages a detent 22 from a slot 23 in the horizontal track 2 and allows the keyboard 1 to be moved along the horizontal track 2. See FIGS. 3 and 4.

Figure 9:
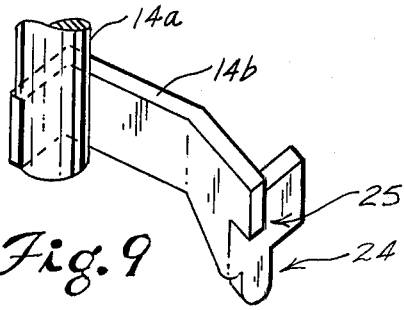
FIG. 9 is a perspective view of a component of the escapement means.

The escapement system is activated by depression of one or a number of keys 3–8 or by depression of either the spacer bar 13 or the keyboard return bar 12 described above. When one or more keys 3–8 are depressed, an escapement activating bar 14, in conjunction with a stem 14*a* and an arm 14*b*, attached thereto, is forced downward. A foot 24, indicated by arrow, of arm 14*b* is forced downward into a slot 23 of the horizontal track 2 thereby disallowing the keyboard 1 movement. See FIG. 9. A further movement downward of arm 14*b* causes an appendage 25, indicated by arrow, of arm 14*b* to contact the lever 21 and force its rotation about fastener 26. This rotation causes the detent 22 to move upwards out of a slot 23 in the horizontal track 2. As the detent 22 moves out of the slot 23, it rotates slightly about fastener 41. Once the detent 22 moves out of the slot 23, it cannot return to the same slot (because of the changed radius between the detent's point of slot contact and fastener 26), but will slide upon the horizontal track 2 towards the next slot 23 as the lever 21 is freed from a downward force and as foot 24 is relieved from a slot 23, and as the keyboard 1 is pulled to the left by the spring reel 27 and cord 28. A flat spring 29, affixed by fastener 30 with spacer 31, to the keyboard base 35, contacts the detent 22 at all times and serves to hold the detent 22 in proper alignment to catch the slot 23, as well as cause the detent 22 to rotate about fastener 41, as well as force the detent 22 into a slot 23, as well as provide shock mitigation to the keyboard 1 when the detent 22 makes contact with a slot 23 in the horizontal track 2.

Rollers 15, with shims 32, are attached to supports 33 by fasteners 34 and the supports are attached to the keyboard base 35 by fasteners 36. The rollers 15 transverse on the horizontal track 2 in concavities indicated by arrow 37. Also attached to the keyboard base 35, by fasteners 38, is a cover 39 having slots which serve as guides for arms **3*b*–8*b***.

Figure 6:
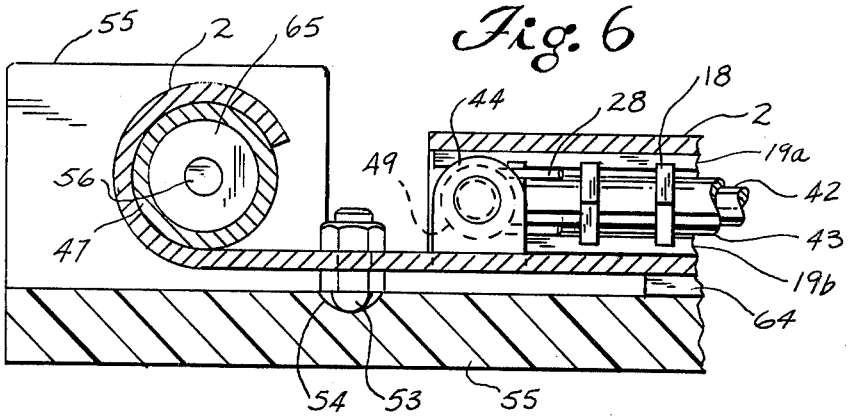
FIG. 6 is a sectional view taken substantially along the line 6—6 of FIG. 1.

A horizontal track 2 is provided for the keyboard 1 to travel upon and also houses the tabs 18 and the spring reel 27 and cord 28. The tabs 18 have a rod 42 passing through each and each tab 18 is separated from one another by a sleeve 43 around the rod 42. The rod 42 rests in turned up "cut-outs" 44 formed in the horizontal track's material and is secured by fasteners 45. The track 2 has a handle, indicated by arrow 46, for lifting and positioning the track 2 during vertical movement, has one end curved to connect to the vertical track 47, has attached by fastener 48 a spring reel 27 and cord 28, and has a pully 49 fastened to a turned up "cut-out" 44 formed in the tracks material. The cord 28 passes over a pully 49 and connects to an arm 50 secured between a support block 51 and the keyboard base 35 by fasteners 52. The track 2 also has protuberances 53 attached near each end and are used to position the track 2 in corresponding indentations 54 in the base 55 and serve to align the track 2 horizontally. See FIGS. 1,4, and 6.

The vertical track 47 allows for moving the horizontal track 2 at desired vertical locations with respect to the base 55. The track 47 is affixed to the base 55 by fasteners 56 and a bushing 65. See FIG. 6.

Figure 10:
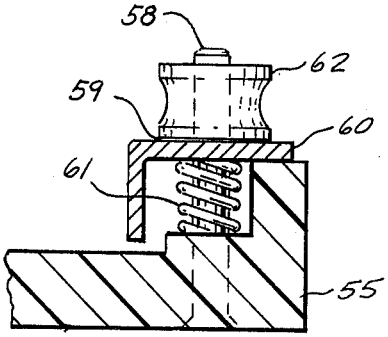
FIG. 10 is a sectional view taken substantially along the line 10—10 of FIG. 1.
Figure 7:
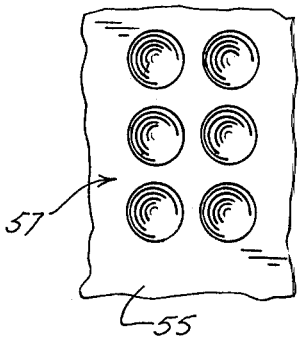
FIG. 7 is a fragmentary top plan view of a typical Braille cell 57 as shown on a lower scale in FIG. 1.
Figure 8:
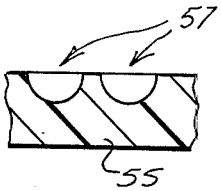
FIG. 8 is a fragmentary sectional view of a typical Braille cell 57 as shown on a lower scale in FIG. 1.
Figure 5:
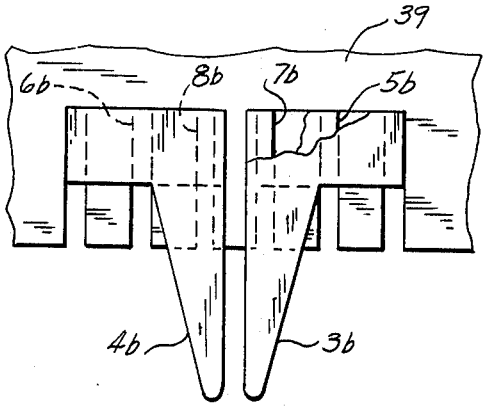
FIG. 5 is view taken along line 5—5 of FIG. 3 in the direction of arrows and is fragmented.

The base 55 has a matrix of indentations, indicated by arrow 57, which corresponds to units and cells of a braille character. See FIGS. 7 and 8. The units and cells correspond to the position of the projectile points of arms **3*b*–8*b* so as to provide for embossing braille characters when the projectile points are forced downward onto a sheet of paper or the like placed between the projectile points and the indentations 57. See FIGS. 5, 7, and 8. A clamping bar 60, with springs 61, thumb nuts 62, screws 58, and washers 59, is provided for holding paper 16 or the like. See FIG. 10. Also the base has secured to it a magnetized strip 63 whereupon its contact with track 2 keeps the track 2 secure to the base 55. The horizontal track 2 has attached to it a resilient material 64 which, when the track 2 is in its operable position, exerts pressure upon the paper 16 and against the base 55 for the purpose of preventing the paper 16 from lifting from the base 55 upon withdrawal of the arm's 3*b*–8*b*** projectile points.

I claim:

1. An apparatus for recording tactile information comprising:

a keyboard having a plurality of keys; means for mounting said keyboard for transverse movement upon a first track; an escapement system including means for alternately initiating and stopping movement of said keyboard upon said first track in response to actuation of one or more of said keys to form embossed characters; means for biasing the keyboard in a return direction; arms extended from said keys and terminating in points for embossing a writing material surface; said escapement system including means for allowing selective free movement of said keyboard along said first track; a keyboard cover with slotted means for aiding in the guiding of said arms and points during embossing;

said first track normally positioned horizontally and upon which said keyboard traverses having a plurality of tabs and means for setting, releasing and by-passing said tabs; said setting and releasing means including means for holding said tabs in set and unset positions by means of magnetic attraction; means for retaining said keyboard in a selected position; said escapement system including slots on said track; means for moveably positioning said first track to a base for alignment purposes; means for restraining a writing material including a resilient material secured to said first track; means for moveably securing said first track to a second track substantially perpendicular to said first track;

said second track normally positioned vertically and serving to allow vertical positioning of said first track in a horizontal position;

said base having a matrix of indentations where a group of said indentations within said matrix corresponds to a six unit cell of the Braille or Braille like system; said base having a series of larger indentations oriented vertically for the purpose of receiving protuberances of said first track and said protuberances being utilized for vertical alignment of said first track; means for magnetically holding down said normally horizontal first track to said base; and means for securing and positioning a writing material to said base.

2. An apparatus recited in claim 1 wherein a plurality of said keys are arranged such that one or more of said keys may be bridged by two or more fingers.

3. An apparatus recited in claim 1 wherein a plurality of said tabs are employed along said first track and said first track having attached or adhered magnetized material for the purpose of selectively retaining said tabs into operable or non operable positions to effect a keyboard locating and stopping position relative to each said tab and relative to a position on a Braille matrix, or Braille like matrix.

4. An apparatus recited in claim 1 wherein magnetized material serves to restrain said first track to said base.

5. An apparatus recited in claim 1 wherein said escapement means are provided for regulating movement of said keyboard with respect to said first track; whereas said escapement means has a lever pivoted about a rotational point; whereas one end of said lever is activated responsive to depression of said keys; whereas said keyboard has a projection which is thrust into slotted means of said first track for halting movement of said keyboard; whereas, at the same time, said lever, by pivoting action, relieves a detent attached thereto from said slotted means; whereas said detent rotates slightly about its own pivotal point and caused by spring action against said detent; whereas, upon release of said keys, said projection is relieved from said slotted means thus allowing movement of said keyboard, via spring reel and cord with respect to said first track, whereas said detent is forced, by said spring into a respective slot of said slotted means thus halting said keyboard.

6. An apparatus recited in claim 1 wherein said first track has concavity means to accept rollers, and rollers are provided, for mobilizing said keyboard upon said first track.

7. An apparatus recited in claim 1 wherein component means located under said keys is selectively responsive to the depression of one or a number of said keys depressed simultaneously; whereby said component means upon the depression of said keys, activates said escapement means.

8. An apparatus recited in claim 1 wherein said indentations are receptive of said projectile points; whereas when a writing surface material is placed between said projectile points and said indentations and when said projectile points are depressed into said indentations, an embossment occurs.

9. An apparatus recited in claim 1 wherein said securing means comprises clamping means for holding material to be embossed.

* * * * *